US005588533A

United States Patent [19]

Farison et al.

[11] Patent Number: 5,588,533

[45] Date of Patent: Dec. 31, 1996

[54] INFLATABLE PACKAGING CUSHION

[75] Inventors: Brian K. Farison, New Milford; William R. Armstrong, Newtown, both of Conn.

[73] Assignee: Sealed Air Corporation, Saddle Brook, N.J.

[21] Appl. No.: 565,664

[22] Filed: Dec. 1, 1995

[51] Int. Cl.[6] ..... B65D 81/02

[52] U.S. Cl. ..... 206/522; 206/590

[58] Field of Search ..... 206/521–523, 206/588–594, 814; 220/403

[56] References Cited

U.S. PATENT DOCUMENTS

| | | | |
|---|---|---|---|
| 1,457,496 | 6/1923 | Butler | 206/522 |
| 1,675,957 | 7/1928 | Reeves | 206/522 |
| 1,827,322 | 10/1931 | Lindermann | 206/522 |
| 2,449,591 | 9/1948 | Couse | 206/522 |
| 2,874,826 | 2/1959 | Matthews et al. | 206/522 |
| 2,907,580 | 10/1959 | Tietig | 206/522 |
| 3,038,593 | 6/1962 | Root et al. | 206/522 |
| 3,131,648 | 5/1964 | Seger | 206/522 |
| 3,199,689 | 8/1965 | Feldkamp | 206/522 |
| 3,346,101 | 10/1967 | Pestka | 206/522 |
| 3,398,501 | 8/1968 | Anninger | 206/522 |
| 3,554,135 | 1/1971 | Duvall et al. | 206/522 |
| 3,667,625 | 6/1972 | Lucas | 206/522 |
| 3,889,743 | 6/1975 | Presnick | 206/522 |
| 3,949,879 | 4/1976 | Peterson et al. | 206/522 |
| 4,235,065 | 11/1980 | Freeman | 206/522 |
| 4,465,188 | 8/1984 | Soroka et al. | 206/522 |
| 4,551,379 | 11/1985 | Kerr | 206/522 |
| 4,793,123 | 12/1988 | Pharo | 206/522 |
| 4,801,213 | 1/1989 | Frey et al. | 206/522 |
| 4,872,558 | 10/1989 | Pharo | 206/522 |
| 4,905,835 | 3/1990 | Pivert et al. | 206/522 |
| 5,042,663 | 8/1991 | Heinrich | 206/522 |
| 5,184,727 | 2/1993 | Dickie et al. | 206/522 |
| 5,348,157 | 9/1994 | Pozzo | 206/522 |
| 5,351,829 | 10/1994 | Batsford | 206/522 |

*Primary Examiner*—Jimmy G. Foster
*Attorney, Agent, or Firm*—Bell, Seltzer, Park & Gibson, P.A.

[57] ABSTRACT

There is provided an inflatable cushion inflated through a single inflation valve. A pair of inflated panels held in place by at least one tie strap connecting the panels rest beneath each end of the bottom of an article to be protected. The cushion has a pair of inflatable end chambers interconnected to the bottom panels and a pair of inflatable side chambers interconnected to the end chambers, which when inflated protect the ends and sides of the article. This is facilitated by internal openings which allow the inflated panels to easily bend underneath the ends of the article and around the corners. There are recesses at each corner which extend from each corner of one internal opening toward a peripheral edge of the cushion to provide a wedge-like portion of the side chambers. In one of the embodiments, an additional pair of internal openings facilitates a pair of top inflatable chambers interconnected to the end chambers to rest on the top of the article. In another embodiment of the present invention, the chamber protecting the upper portion of the article includes a single inflatable chamber which folds across the top of the article. The top chamber has an internal opening in the middle thereof formed by a weld. Extending inwardly from the weld are portions of each thermoplastic sheet which remain after the cushion has been cut and adapted to hold a thin article.

11 Claims, 2 Drawing Sheets

INFLATABLE PACKAGING CUSHION

FIELD OF THE INVENTION

The present invention relates to inflatable packaging cushions and more particularly to inflatable packaging cushions which protect all sides of an article during shipping.

BACKGROUND OF THE INVENTION

When articles are packaged in a container or box for shipping there frequently are void spaces in the container. Protective packaging material for articles of different sizes and shapes is commonly used to cushion articles during shipping. There are numerous types and forms of packaging material for this purpose including waste paper, embossed paper, laminated bubble paper and plastic beads, known as peanuts. These forms of cushioning material do not always provide the cushioning needed when shipping and are generally one-use items which are thrown away after use.

In seeking better protective packaging materials various forms of air inflated cushions have been suggested. One such example is U.S. Pat. No. 4,798,123 to Pharo which discloses an inflatable bag having a pouch for retaining an article and adapted to be rolled-up to assume a spiralled configuration for cushioning the article. Such bag is inflated after the article is placed in the pouch, the air bag rolled around the package and placed in a shipping container. Another example of an inflatable packaging cushion is described in U.S. Pat. No. 5,042,663 to Heinrich, which discloses an inflatable cushion comprising a plurality of joinable flexible bladders. A further example of an inflatable packaging cushioning is set forth in U.S. Pat. No. 3,889,743 to Presnick who discloses thermoplastic bags defining an inflation chamber inside of a box. An improvement in air inflatable packaging material is shown in U.S. Pat. No. 5,348,157 to Pozzo which discloses various forms of inflatable cushions serving to protect one or more sides and/or ends of an article. These inflatable packaging cushions do not always protect all of the six sides of an article with a single cushion.

The disadvantages of the prior art packaging materials discussed above are overcome by use of the inflatable packaging cushion of the present invention as hereafter described.

SUMMARY OF THE INVENTION

Therefore, it is an object of the present invention to provide a single inflatable packaging cushion for protecting all sides of an article.

Another object of the present invention is to provide an inflatable packaging cushion which easily folds around the edges of a rectangular article.

A further object of the present invention is to provide an inflatable packaging cushion which is inflated through a single valve and protects all sides of an article.

Yet another object of this invention is to provide an inflatable cushion in which at least two of the cushion chambers are attached together by at least one tie strap.

It has been found that the foregoing objects are accomplished in accordance with this invention by providing a cushion formed from a pair of thermoplastic sheets that have been juxtaposed one upon the other, heat sealed around their peripheral edge and cut to the desired shape and size. The cushion is designed so that it may be inflated through a single inflation valve. When the cushion is at least partially inflated a pair of inflatable bottom panels rest beneath each end of the bottom of an article to be protected. These bottom panels are held in place by at least one tie strap of varying width and configuration connecting the panels. The cushion has a pair of inflatable end chambers interconnected to the bottom panels via an air passageway and a pair of inflatable side chambers interconnected to the end chambers, which, when inflated, protect the ends and sides of the article. Internal openings between each end chamber and bottom panel facilitate the inflated panels to easily bend underneath the ends of the article and around the corners. Recesses are provided which extend from each corner of an internal opening located beneath the article toward the peripheral edge of the cushion. When inflated, side chambers form wedge-like portions which come into contact with the sides of the article and tip the side chambers upwardly to wedge against the sides of the article. In one of the embodiments, an additional pair of internal openings facilitates a pair of top inflatable chambers interconnected to the end chambers to rest on the top of the article. In another embodiment of the invention, the bottom inflatable panels are connected by at least two tie straps.

In yet another embodiment of the present invention, the cushion protecting the upper portion of the article includes a single inflatable chamber which folds across and covers a major portion of the top of the article. The single top chamber has an internal opening in the middle thereof formed by a weld. Extending inwardly from the weld are portions of each thermoplastic sheet which remain after the cushion has been cut. The portions are adapted to hold a thin article, such as a computer hard drive between the sheets.

BRIEF DESCRIPTION OF THE DRAWINGS

Other objects, features and advantages of the invention will become apparent from the following detailed description of the invention when taken in conjunction with the accompanying drawings, in which.

DETAILED DESCRIPTION OF THE PREFERRED EMBODIMENTS

Figure 1:
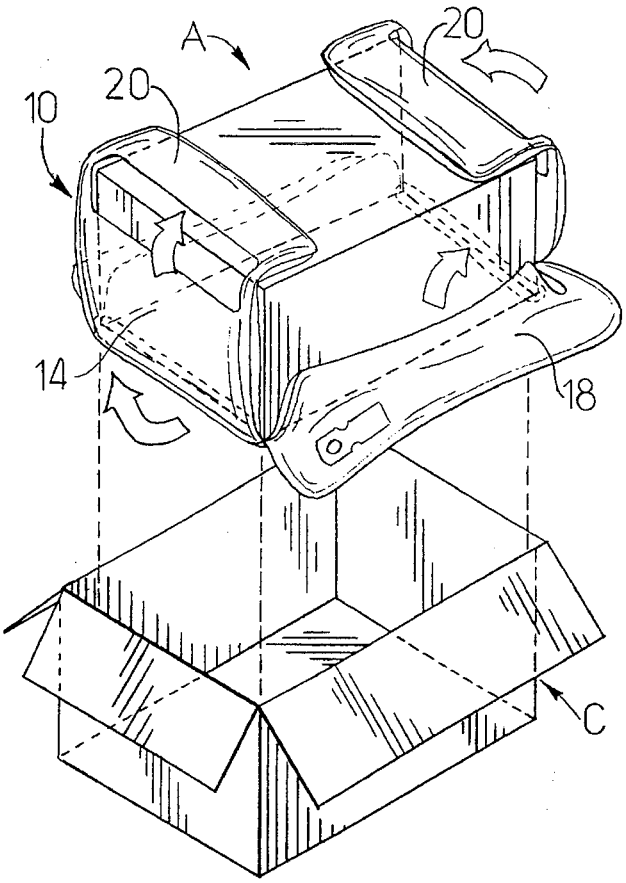
FIG. 1 is an isometric view illustrating an embodiment of the inflatable packaging cushion of the present invention in its inflated form surrounding an article to be protected as it is used in combination with a shipping container.
Figure 2:
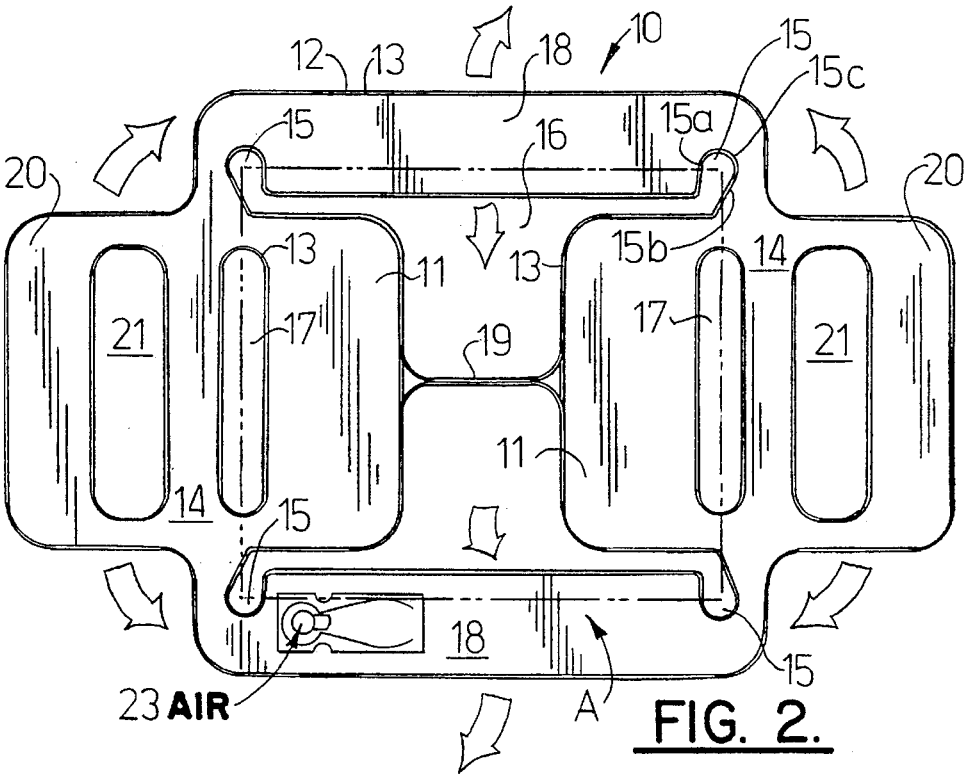
FIG. 2 is a plan view of the inflatable packaging cushion of FIG. 1 made in accordance with this invention in its deflated state.

Referring now to the drawings and in particular FIGS. 1 and 2, there is shown the inflatable packaging cushion 10 made in accordance with the present invention surrounding an article A adapted to be placed within a carton or box C.

The inflatable packaging cushion 10 includes panels or chambers interconnected through internal passageways and adapted to protect each of the sides of article A. The inflatable cushion 10 is made from two sheets of thermoplastic material which are heat sealed together around their external peripheral edge 12 and which is generally adapted to the dimensions of, for example, a box or carton C made from corrugated paperboard or the like. The inflatable cushion 10 includes an internal opening 16, capable of receiving an article A to be cushioned, defined generally by internal recesses 15 extending from each of the corners of the internal opening 16 toward the peripheral edge 12 of the cushion 10.

The inflatable cushion 10 is made of two sheets of air impervious thermoplastic material. Any number of commercially available air impervious thermoplastic materials may be used. The sheets are juxtaposed over each other and sealed together in the region of their peripheral edges—i.e., weld lines 13. The sealing may be formed by conventional techniques, for example, heat sealing. In addition, the internal edges are welded in the same manner also along weld lines 13 and the cushion cut to form the various internal openings. The thermoplastic sheets should be sufficiently flexible to adapt to the contours of the article to be packaged and, at the same time, sufficiently robust not to be pierced by possible highly projecting or pointed parts of the article A to be protected. The cushions of these materials can be deflated and reused but can also be incinerated, without release of toxic vapor, or can be recycled.

As shown in FIG. 2, the inflatable cushion 10 is designed so that when it is inflated, a pair of inflatable panels 11 lies underneath each end of the bottom of the article A. These panels 11 should be sufficiently large to provide protection to the underside of the article A when the cushion is properly inflated. An outline of article A illustrates how the article fits on the deflated cushion 10. As the cushion 10 is inflated, end chambers 14, positioned at each end of the article A and interconnected via air passageways to panels 11, rise around the corners of the article A at the recesses 15 to protect the ends of the article A. The ability of the end chambers to fit against the ends of the article is facilitated by internal openings 17 which allow the inflated end chambers 14 to easily bend around the lower edges of the article.

Figure 4:
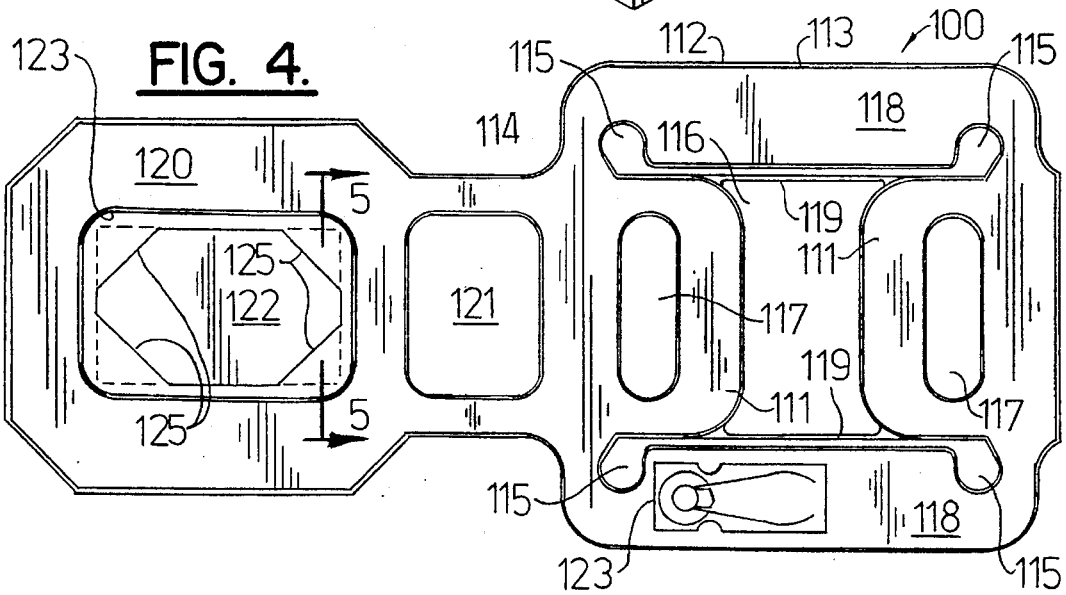
FIG. 4 is a plan view of the embodiment of the present invention shown in FIG. 3 in deflated condition.

The pair of inflatable panels 11 are held in place by tie strap 19. The tie strap 19 may be formed as a weld seam when the peripheral edge 12 and the internal edges 13 of cushion 10 are formed and the cushion is die cut. The width and configuration of the tie strap 19 may vary. Alternately, the panels 11 may be connected by a plurality of tie straps 119 as shown in FIG. 4.

The sides of the article A are protected by side inflation chambers 18, interconnected via air passageways to end chambers 14, when inflated. Side chambers 18 form wedge-like chambers which come into contact with the sides of the article and pivot upwardly, shown by the arrows in FIGS. 1 and 2, to wedge against the sides of the article.

There are internal recesses 15 at each corner extending from the corners of internal opening 16 toward a peripheral edge of the cushion. As may be seen in FIG. 2, the recesses 15 delimit wedging parts formed by side inflation chambers 18 capable of coming into contact with the article A by pivoting around zones generally defined by the area of the air passageway between the recesses 15 and the peripheral edge 12, connecting end chambers 14 and side chambers 18. The pivoting of the wedging portion of chambers 18 around the pivoting zones enables the size and/or the shape of the internal opening 16 to be varied in order to adapt it to objects of various sizes and shapes, while maintaining a holding pressure on the article by virtue of a return movement which is exerted in the region of the pivoting zones.

The shape of each recess 15 and/or of the peripheral edge 12 is such that, in this region, two pivoting zones located respectively at two locations where the space between the recesses 15 and the external peripheral edge 12 of the cushion 10 is the least. In this example, as may be seen in FIG. 2, the peripheral edge 12 is substantially straight between the end of side chambers 18 and each recess 15 is substantially droplet shaped, that is to say has a shape constituted by two lines **15*a*, 15*b* diverging from a corner of the internal opening 16 towards the peripheral edge 12 and joined together by a rounded portion 15*c*** in the vicinity of the edge.

In the region of each rounded portion **15*c* there is a zone where the space between the said recess 15 and the external peripheral edge 12 is the least and this area defines a pivoting zone. The shapes of the recesses 15 are not unique and a person skilled in the art will be able to make modifications to them, knowing that it suffices to create, between one recess 15 and the peripheral edge 12, at least one narrowing so as to define a pivoting zone. For example, it is possible to envisage the external peripheral edge 12 having indentations in the region of each recess 15** in order to define, with the said recess, the preferential pivoting zones.

The four lateral edges of article A placed in the inflatable cushion 10 are engaged in the recesses 15; they are therefore not in contact with the cushion, which minimizes the risk of wear or of deterioration of the cushion chambers by these intersection edges. The recesses 15 moreover constitute by virtue of their deformability, preferentially impact-damping zones.

The top of article A is protected by a pair of inflatable top chambers 20 interconnected via passageways to end chambers 14. In the embodiment shown in FIGS. 1 and 2, the top chambers 20 are sufficiently large to provide protection to the top of article A when the cushion is properly inflated. It is not necessary that the top chambers 20 overlay the entire area of the article. The size of these chambers may be easily determined by those skilled in the art. An internal opening 21 between each of the top chambers 20 and the end chambers 14 facilitate the top chambers 20 to easily bend around the upper corners of the end of the article. Of course, the internal openings 21 may be a series of smaller openings located in approximately the same location as the openings 21 shown in FIG. 2.

The inflatable packaging cushion 10 includes a single valve 23 for inflation. As noted in FIG. 2, the inflatable chamber is inflated through inflation valve 23 which may be located at any one of a number of regions along the sides or top of the cushion. The inflation valve 23 is any one of the well-known types of self-sealing inflating valve which typically comprises two thin sheets of plastic juxtaposed and welded together along lines so as to form a passage conduit for an inflating hose. The valve 23 is located between the two sheets forming the cushion. As a filler medium, preferably air, is passed into the inflation valve 23, the chambers and panels in the cushion 10 inflate around the article A. The internal openings 16, 17 and 21 allow the inflation panels 11, end chambers 14, side chambers 18 and top chambers 20 to easily bend underneath and around the ends and sides of the article and across the top. Furthermore, it is not necessary to completely fill the cushion with air to provide the desired protection.

Figure 3:
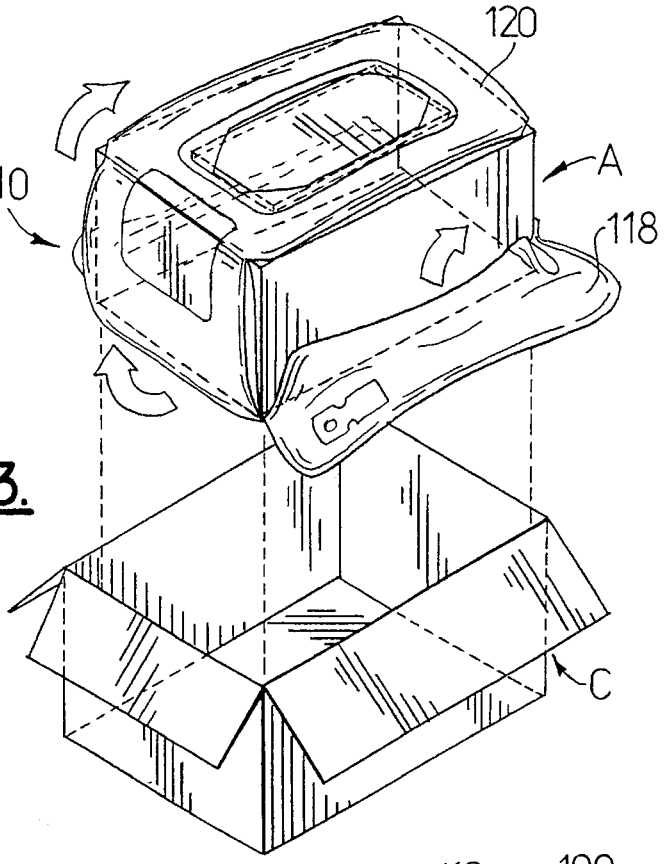
FIG. 3 is an isometric view of another embodiment of the inflatable cushion of the present invention.
Figure 5:
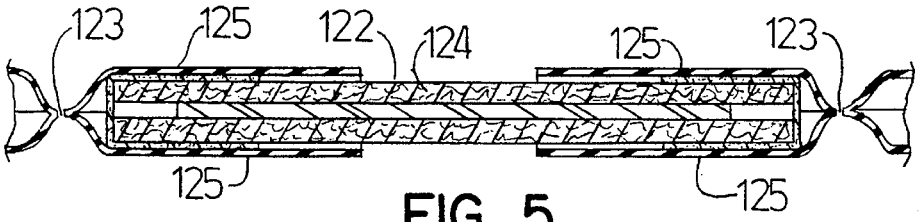
FIG. 5 is a sectional view taken along line 5—5 of FIG. 4 and illustrates the top chamber of an embodiment of the invention holding in place a thin flat article.

In another embodiment, that shown in FIGS. 3–5, there is provided an inflatable packaging cushion 100 made from two sheets of thermoplastic material which are heat sealed together at welds 113 around their external peripheral edge 112. In this embodiment, the cushion has two tie straps 119 for maintaining a pair of bottom panels 111 in position. The embodiment shown in FIGS. 3–5 is similar in part to the embodiment of FIGS. 1–2 in that it includes end chambers 114 connected to the bottom panels 111 via air passageways and the end chambers are connected to side chambers 118 in the same manner. This embodiment includes recesses 115 that operate in the same manner as those of FIGS. 1–2. As shown, the tie straps 119 are located at the sides of the bottom panel. Internal openings 116 and 117 sealed at their edges and corresponding to internal openings 16 and 17 are provided. Also inflation valve 123 is provided.

An alternative embodiment of the present invention, the upper inflatable chambers are replaced by a single inflatable chamber 120 which overlies at least a major portion of the top of the article as shown more clearly in FIGS. 3 and 4. The inflatable top chamber 120 described in FIG. 4 has an internal opening 121 in the middle thereof which is formed by a heat seal weld 123. The opening 122 serves to keep the chamber 120 from over inflating. Extending inwardly from the weld 123 are portions of each thermoplastic sheet 125 which remain when the cushion is cut. The portions are adapted to retain in place a thin elongated article 124, such as the hard disk drive of a computer. As shown in FIG. 4, the weld line 113 forming the internal opening 122 is split at its inner edge around the radius at each corner to alleviate any stresses caused by an article being retained with the opening.

In operation, the inflatable chamber is designed for an article of a specific size and is inflated and positioned around the article and then placed into a carton or box for shipping.

The invention advantageously applies to the transporting and to the handling of any fragile merchandise, and especially electronic, computer or other equipment with the ability to use a single inflatable cushion to protect all the sides of the product and to be able to reuse it several times.

The invention has been described in detail with particular reference to a preferred embodiment and the operation thereof, but it is understood that variations, modifications, and the substitution of equivalent means can be effected within the spirit and scope of the invention.

What is claimed is:

1. An inflatable packaging cushion of flexible material adapted to be at least partially charged with filler medium and having an external peripheral edge adapted to the shape and dimensions of a packaging receptacle comprising:

said cushion having at least one internal opening capable of receiving an article to be packaged such that the sides of said article are completely encircled a pair of inflatable end chambers interconnected with a pair of inflatable side chambers via passageways;

a pair of inflatable bottom panels interconnected to each of said end panels and at least one tie strap located in said internal opening connecting said bottom panels so as to maintain them in position when said cushion is inflated;

a plurality of recesses extending from said internal opening toward the peripheral edges of said recesses delimiting wedging parts as portion of said side chambers, said wedging parts capable of coming into contact with the sides of said article, zones for pivoting of the wedging parts being defined between the recesses and the peripheral edge, said wedging parts being adapted so as to automatically pivot during inflation of the inflatable packaging cushion about a line extending generally between two successive recesses in order to vary the size and shape of each internal opening, said internal opening being completely encircled by said wedging parts;

at least one internal opening between each of said bottom panels and said end chambers to facilitate said cushion extending around the bottom ends of said article; and filling means for at least partially charging said cushion with filler medium.

2. The inflatable packaging cushion according to claim 1 wherein said cushion comprises a pair of juxtaposed thermoplastic sheets having the outer peripheral edges thereof sealed together to form said cushion.

3. The inflatable packaging cushion according to claim 1 wherein said filling means is a single self-sealing inflation valve.

4. The inflatable packaging cushion according to claim 1 having a plurality of tie straps.

5. The inflatable packaging cushion according to claim 1 further comprising at least one top chamber interconnected to said end chamber.

6. The inflatable packaging cushion according to claim 1 further comprising top chamber overlaying at least a majority of said article and having an internal opening therein defined by a weld.

7. The inflatable packaging cushion according to claim 6 further comprising portions of said cushion extending inward from said weld into the peripheral of said internal opening so as to define a means for holding a thin article.

8. The inflatable packaging cushion according to claim 1 wherein said filler medium is air.

9. An inflatable packaging cushion of flexible thermoplastic material adapted to be at least partially charged with air and having an external peripheral edge adapted to the shape and dimensions of a packaging receptacle comprising:

said cushion having a pair of juxtaposed thermoplastic sheets having the outer peripheral edges thereof sealed together to form said cushion and having at least one internal opening capable of receiving an article to be packaged such that the sides of said article are completely encircled a pair of inflatable end chambers interconnected with a pair of inflatable side chambers via passageways;

a pair of inflatable bottom panels interconnected to each of said end panels and at least one tie strap located in said internal opening connecting said bottom panels so as to maintain them in position when said cushion is inflated;

a plurality of recesses extending from said internal opening toward the peripheral edges of said recesses delimiting wedging parts as portion of said side chambers, said wedging parts capable of coming into contact with the sides of said article, zones for pivoting of the wedging parts being defined between the recesses and the peripheral edge, said wedging parts being adapted so as to automatically pivot during inflation of the inflatable packaging cushion about a line extending generally between two successive recesses in order to vary the size and shape of each internal opening, said internal opening being completely encircled by said wedging parts;

at least one internal opening between each of said bottom panels and said end chambers to facilitate said cushion extending around the bottom ends of said article;

at least on internal opening between each of said bottom panels and said end panels;

at least one inflatable top chamber interconnected to said end chamber and having at least one internal opening between said at least one top chamber and said end chamber; and a single self-sealing inflation valve for at least partially charging said cushion with air.

10. The inflatable packaging cushion according to claim 9 further comprising top chamber overlaying at least a majority of said article and having an internal opening therein defined by a weld.

11. The inflatable packaging cushion according to claim 10 further comprising portions of said cushion extending inward from said weld into the peripheral of said internal opening so as to define a means for holding a thin article.

* * * * *

UNITED STATES PATENT AND TRADEMARK OFFICE

CERTIFICATE OF CORRECTION

PATENT NO. : 5,588,533

DATED : December 31, 1996

INVENTOR(S) : Farison, et al.

It is certified that error appears in the above-indentified patent and that said Letters Patent is hereby corrected as shown below:

On the cover page, U.S. References, Column 1, line 11, delete "Anninger" and insert --Aninger-- therefor.

Column 1, line 22, delete "4,798,123" and insert --4,793,123-- therefor.

Column 1, line 33, delete "who" and insert --which-- therefor.

Column 5, line 10, delete "An" and insert --As an-- therefor.

Column 5, line 44, and Column 6, line 33, after "encircled" insert --by--.

Column 5, line 54 and Column 6, line 43, delete "portion" and insert --portions-- therefor.

UNITED STATES PATENT AND TRADEMARK OFFICE

CERTIFICATE OF CORRECTION

PATENT NO. : 5,588,533

DATED : December 31, 1996

INVENTOR(S) : Farison, et al.

It is certified that error appears in the above-indentified patent and that said Letters Patent is hereby corrected as shown below:

Column 6, line 16, after "comprising" insert --a--.

Column 6, line 20 and Column 8, line 1, after "peripheral" insert --edges--.

Column 6, line 58, delete "on" and insert --one-- therefor.

Signed and Sealed this

Twenty-second Day of July, 1997

Bruce Lehman

*Attest:*

BRUCE LEHMAN

*Attesting Officer*

*Commissioner of Patents and Trademarks*